United States Patent [19]

Weiss

[11] 3,986,568

[45] Oct. 19, 1976

[54] APPARATUS FOR MAKING UNDERGROUND PASSAGES

[76] Inventor: Richard Weiss, 4130 Moers, Germany

[22] Filed: Aug. 12, 1975

[21] Appl. No.: 604,071

[30] Foreign Application Priority Data

Oct. 22, 1974 Germany ..... 7435191[U]

[52] U.S. Cl. ..... 175/19; 175/409; 175/61; 299/33

[51] Int. Cl.[2] ..... E21B 11/02

[58] Field of Search ..... 175/19–23, 175/61, 62, 171, 398, 92, 402–405, 409, 73; 61/56, 84, 89; 299/33, 19, 20, 21

[56] References Cited

UNITED STATES PATENTS

| | | | |
|---|---|---|---|
| 887,952 | 5/1908 | Milligan | 175/171 X |
| 1,853,379 | 4/1932 | Rottinoff | 175/402 X |
| 1,948,707 | 2/1934 | Gilman | 175/62 X |
| 1,948,733 | 2/1934 | Robertson | 61/84 |
| 2,019,719 | 11/1935 | Miller | 175/409 X |
| 2,182,477 | 12/1939 | Hollingsworth | 175/398 X |

FOREIGN PATENTS OR APPLICATIONS

| | | | |
|---|---|---|---|
| 1,809,322 | 6/1970 | Germany | 61/84 |
| 249,710 | 7/1910 | Germany | 61/56 |

*Primary Examiner*—Stephen J. Novosad
*Attorney, Agent, or Firm*—Michael J. Striker

[57] ABSTRACT

The apparatus has an annular body of reinforced centrifugally cast concrete. The leading axial end of the body is provided with a cover of sheet steel which forms a soil-penetrating cutting edge, and the trailing axial end of the body is provided with a steel reinforcing ring and with circumferentially spaced recesses into which respective pressure-exerting instrumentalities can engage, which serve to press the body into the soil and to control its direction of penetration in the same.

10 Claims, 5 Drawing Figures

APPARATUS FOR MAKING UNDERGROUND PASSAGES

BACKGROUND OF THE INVENTION

The present invention relates to an apparatus for making underground passages.

It is well known to install underground pipelines to make tunnels, waste-disposal systems and the like, by digging ditches and installing cement or other pipes in these ditches whereupon the ditches are closed and the pipe is buried. However, there are applications where this approach cannot be used. For example, if such pipeline is to be installed in ground on which structures are already erected, such as if it is to traverse the ground beneath buildings or the like, it is evidently not possible to dig up the ground underneath the building. For such circumstances a different system has been developed according to which a pit is dug or otherwise provided at an appropriate location, and pipes are driven into a sidewall of the pit below ground level, being rammed forward by hydraulic presses or the like, so that they penetrate through the ground in the desired direction without any necessity for digging up the ground.

In this latter type of application it is important that the penetration of the pipes through the ground be facilitated as much as possible, and that the entry of soil into the pipes be prevented. For this purpose it is known to use an apparatus having a head which is secured to the leading end of the first pipe to be driven into the ground (which is followed by a string of successive pipes that are added to the trailing end of the first pipe) and which serves to displace the soil ahead of it as it penetrates the soil.

It stands to reason that these heads are subject to very high stresses as they are being driven into and through the soil, and that they must accordingly be of very strong construction. Heretofore, these heads have been made of heavy sheet steel parts which are welded to the desired configuration. This, however, involves considerable manufacturing expenses, since the steel must be of good quality ad is therefore expensive, and since the welding-together of the various sheet steel components to form a head of the desired shape is also expensive.

Summary of the Invention

Accordingly, it is a general object of this invention to overcome the disadvantages of the prior art.

More particularly, it is a general object of the present invention to provide an improved apparatus having a head of the type in question, which is at least equally strong and sturdy as those known from the prior art, but which can be produced at considerably less expense.

Another object of the invention is to provide such a corer or head which is as resistant to wear as those of the prior art.

In keeping with these objects, and with others which will become apparent hereafter, one feature of the invention resides in apparatus for making underground passages, and the apparatus having a head which comprises an annular body of reinforced centrifugal concrete, this body having a leading axial end and a trailing axial end. Means are provided, forming a soil-penetrating cutting edge on the leading axial end of the body, and a reinforcing ring is provided on the trailing axial end thereof. A plurality of circumferentially spaced recesses is formed in the body at the trailing axial end and is adapted for engagement with respective pressure-exerting instrumentalities which press the body into the soil and control its direction of penetration in the same.

A head produced according to the present invention can be manufactured quite inexpensively in the type of centrifugal-casting equipment which is in any case used to produce the concrete pipes that are to be installed underground with the aid of the corer. This manufacture is very simple and inexpensive, and as a result of the fact that the means forming the soil-penetrating cutting edge, advantageously in form of sheet steel components, can be supported on the concrete of the annular body and is therefore very well supported and subject to very little damage and wear. The strength of the annular body is very adequate for the stresses which the corer will encounter, particularly if the annular body is reinforced with steel in the manner of conventional reinforced concrete, and it is particularly advantageous if the concrete is of the type which includes synthetic plastic resin material as a part of its components. The means forming the cutting edge and the reinforcing ring can be secured to the annular body of reinforced concrete by placing them into the centrifugal casting mold prior to the manufacture of the annular body, so that they become united with the concrete of the body during the manufacture of the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
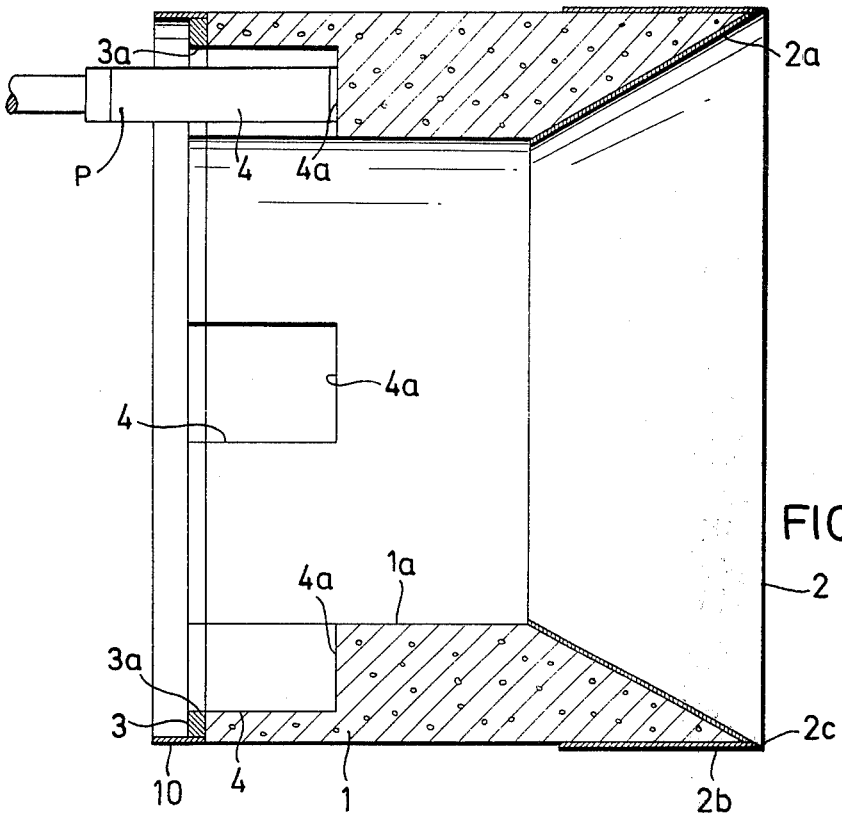
FIG. 1 is an axial section through one embodiment of the invention.
Figure 2:
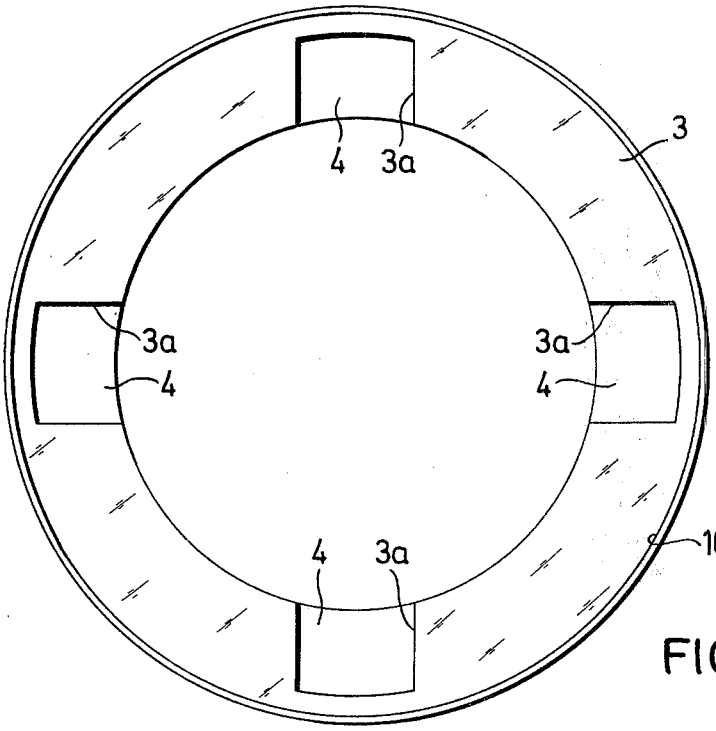
FIG. 2 is an end view looking towards the right in FIG. 1.

Referring now in detail to the drawing, and firstly describing the embodiment illustrated in FIGS. 1 and 2 thereof, it will be seen that the soil-penetrating head illustrated in FIGS. 1 and 2 has a steel-reinforced body 1 of centrifugally cast concrete. One axial end of the body 1, i.e. the leading end which is to be pushed into the soil, is provided with means forming a cutting edge 2. The opposite or trailing axial end of the body 1 is provided with a reinforcing ring 3 of steel. Both the means 2 and the ring 3 may be united with the concrete of the body 1 during the centrifugal casting operation during which the body 1 is formed.

In the embodiment of FIGS. 1 and 2 the means 2 comprises an inner conically tapering sheet-steel annulus 2*a* located in the interior of the similarly conically tapering body 1, and an outer cylindrical sheet-steel annulus 2*b* which surrounds the exterior of the body 1 rearwardly of and up to the leading axial end thereof. The annuli 2*a* and 2*b* are connected together at their edge 2*c* where they join, and welding is advantageous for this connection. In fact, the weld along the edge 2*c* can serve a reinforcing purpose. The edge 2*c* then constitutes the soil-penetrating cutting edge. The conically tapering annulus 2*a* extends from the cutting edge 2*c* to the area where the interior taper of the body 1 ends and the interior of the body 1 becomes cylindrical. The body 1 is clearly hollow, as shown in the drawing. It is advantageous in this particular embodiment if the axial length of the outer annulus 2*b* is at least 30 centimeters, but this length can be greater if desired.

The steel ring 3 has a reinforcing function, as already indicated. In the region of the respective circumferentially spaced recesses 4 which are formed in the trailing end of the body 1 (compare FIG. 2) the ring 3 is provided with respective cutouts 3*a* so that pressure-exerting instrumentalities (such as hydraulic presses or jack) can engage in these recesses 4 and press against the abutment faces 4*a* thereof. The purpose of this is not only to force the corer into the soil with its cutting edge 2*c*, as disclosed in German patent No. 1,101,479, but also to provide a selective pressure at different circumferential locations of the corer in order to "steer" the corer as it travels through the soil, to make it advance in a selected direction, as disclosed on pages 150–152 of the magazine "Baumaschine und Bautechnik," volume 4, April 1971. If desired, the recesses 4 or at least the faces 4*a* thereof may be clad with reinforcing material, such as sheet steel. The head is further provided with a rearwardly extending annular member 10 to cover the points of entry of the pressure-exerting instrumentalities P into the recesses 4.

A discussion of the technique used for driving the head into the soil is not believed to be necessary, this being already known from the art. Briefly summarized, the head will be pressed into the soil in a more or less horizontal direction, in the direction in which the pipes are to be installed. When the hydraulic presses P or jacks, or similar pressure-exerting instrumentalities, have pressed the head as far into the soil as is possible, they are retracted, a first pipe section of concrete or the like is advanced behind the head until it abuts the trailing end thereof, and pressure is now exerted upon the trailing end of the first pipe section which forces the head deeper into the soil and follows it until the first pipe section also is fully embedded in the soil. Thereupon, another pipe section is abutted against the trailing end of the first pipe section and the operation is repeated.

In the embodiment of FIGS. 1 and 2 it will be noted that the corer is hollow so that soil will penetrate into it and into subsequently arranged pipes, and this soil will then have to be removed in appropriate manner.

Figure 3:
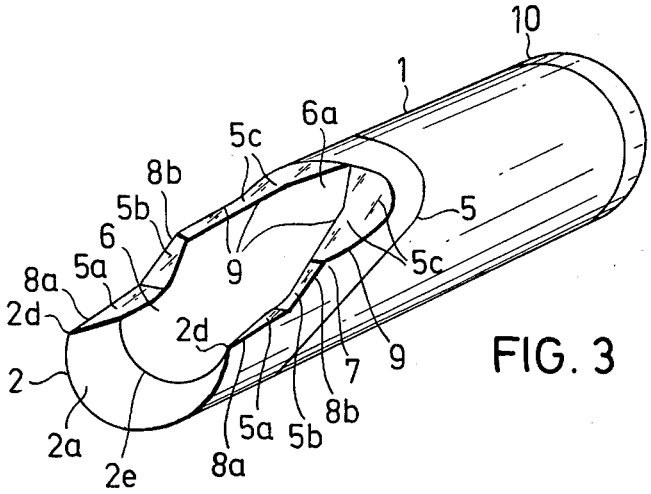
FIG. 3 is a perspective view of a further embodiment of the invention.
Figure 4:
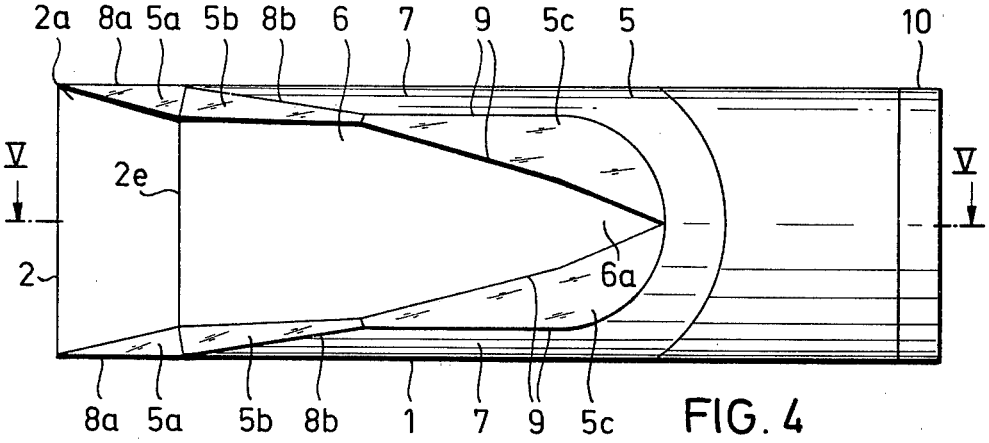
FIG. 4 is a top-plan view of the embodiment in FIG. 3.
Figure 5:
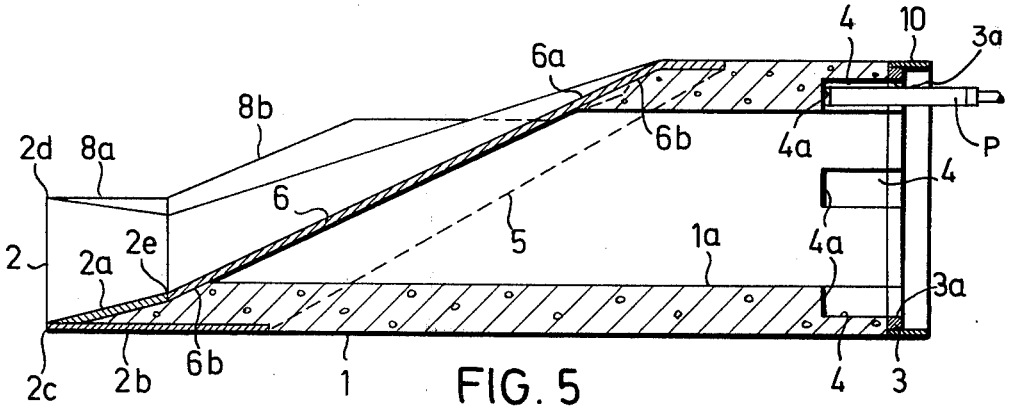
FIG. 5 is an axial section taken on line V—V of FIG. 4.

A further embodiment of the invention is illustrated in FIGS. 3–5. In this embodiment like reference numerals identify like elements as before. It should be understood that the centrifugally-cast concrete body 1 in the embodiment of FIGS. 3–5 is also hollow, but that it is closed at its leading end to prevent the entry of soil into its interior.

In FIGS. 3–5 the body 1 again has the means 2 forming the cutting edge as in th preceding embodiment. However, the means 2 here extends only on the lower semi-cylindrical part of the body 1 at the leading end of the latter. The lateral upper ends 2*d* of the means 2, which is again of sheet steel as described before, merge with a sheet steel cover 5 having lateral soil-displacing faces 5*a*,5*b*,5*c* which are connected by a curved wall portion 6 of sheet steel that closes the leading end of the annular body 1, i.e. the cylindrical portion 1*a* thereof, against penetration of soil. The wall 6 is part-cylindrically curved and is inclined upwardly and rearwardly towards the trailing end of the body 1 as shown in the drawing, particularly in FIGS. 3 and 5. The lateral soil-displacing faces 5*a*,5*b*, and 5*c*, as well as the wall 6 form together with the conical inner part-annular sheet-steel member 2*a* and with the part-cylindrical outer sheet-steel member 2*b* a rigid structural unit, for example by being welded together.

Note should be taken that subsequent to (i.e. rearwardly of) the means 2 the soil-displacing faces 5*a*, 5*b* and 5*c* are so configurated intermediate the lateral side portions 7 of the body 1 that the wall 6 rises substantially uniformly from the rear end 2*e* of the means 2 up to the upper end of the upper part-cylindrical portion of the body 1.

The faces 5*c* which are located laterally of the upper end part 6*a* of the wall 6 in the upper part-cylindrical portion of the body 1, are partially flattened and are inclined at opposite sides of the longitudinal axis of symmetry, in direction towards one another and towards the axis. This is particularly clearly shown in FIGS. 3 and 5. The inclined wall 6 is supported over its entire outer marginal region 6*b* by the body 1 and adjacent to the arcuately curved means 2 the wall 6 is bounded by upwardly facing elongated cutting edges 8*a*, 8*b* which extend substantially symmetrically at opposite sides of the axis of symmetry of the body 1 and which serve to cut through the soil subsequent to penetration into the soil of the cutting edge 2*c*, so that subsequent to this penetration a cutting effect in upward direction in the soil is obtained by the cutting edges 8*a* and 8*b*, severing the soil being penetrated from the soil which is located laterally of the corer, and making it easier for the corer to press the soil upwardly by means of the wall 6.

The drawing also shows in FIGS. 3–5 that the upwardly directed cutting edges 8b are slightly inclined subsequent to a substantially horizontal portion 8*a* and in direction towards the faces 5*c*. In the region of these faces 5*c* the cutting edges 8*b* merge into blunt edge portions 9 which are outwardly inclined and which constitute the delimitation of the faces 5*c* with reference to the arcuately curved outer circumference of the body 1 on the one hand, and with reference to the upper tapering end portion 6*a* of the substantially part-cylindrically curved wall 6, on the other hand.

The head of FIGS. 3–5 is thus closed at its leading end and no soil can penetrate into its interior. Its rear end, however, is open and as in the case of FIGS. 1–2, the head of FIGS. 3–5 has a cross-sectional dimension corresponding to that of the pipes which are to be installed following its penetration into the soil. It is provided with recesses 4 as is the head of FIGS. 1–2, and these recesses again have abutment faces 4*a* for engagement by the pressure-exerting instrumentalities. The ring 3, as well as the means 2 with the cover 5 and the wall 6, can be united with the concrete of the body 1 during the centrifugal casting of the body 1, in the manner described earlier. Thus, the head of FIGS. 3–5 can be produced in a single operation, as can the corer of FIGS. 1–2. This does not exclude the possibility, of course, that the means 2 and the ring 3 might be connected to the body 1 by separate means and in a separate operation, but their connection and uniting with the concrete of the body 1 during the centrifugal casting of the latter, have the evident advantage of requiring only a single operation and of being extremely simple and inexpensive.

It is a particular advantage of the embodiment in FIGS. 3–5 that the members 2*a* and 2*b*, the cover 5 and at least the outer marginal portions of the wall 6 are well supprted on parts of the body 1, so that no further support for these elements, especially for the wall 6, need be provided to be able to withstand the stresses to which the device will be subjected.

No detailed description need be given of concrete, such as centrifugally cast concrete, which as synthetic resin admixed wih it. Concrete of this type is known in the art and is particularly resistant to breaking stresses as a result of the admixture of the concrete therewith.

It will be understood that each of the elements described above, or two or more together, may also find a useful application in other types of constructions differing from the types described above.

While the invention has been illustrated and described as embodied in a head for making underground passages, it is not intended to be limited to the details shown, since various modification and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for making underground passages, comprising an annular body of reinforced concrete, said body having a leading axial end and a trailing axial end; means forming a soil-penetrating cutting edge at said leading axial end and comprising a sheet steel ring surrounding said body at said leading axial end and a conical sheet steel ring overlying the inner circumferential surface of said body at said leading axial end, said sheet steel rings having axial edges which are adjacent to and connected with one another to form said cutting edge; a reinforcing steel ring at said trailing axial end; a plurality of circumferentially spaced recesses in said body at said trailing axial end; and a plurality of pressure exerting means respectively engaged in said recesses for pressing said body into the soil and for controlling its direction of penetration into the same.

2. Apparatus as defined in claim 1, wherein said cyldrinical sheet-steel ring has an axial length of at least 30 cm.

3. Apparatus as defined in claim 1, wherein said concrete is synthetic resin concrete.

4. Apparatus as defined in claim 1, wherein said annular body has an upper and a lower part-cylindrical portion, said cutting edge forming means being provided only on said lower portion.

5. Apparatus for making underground passages, comprising an annular body of reinforcing concrete, said body having a leading axial end and a trailing axial end; means forming a soil-penetrating cutting edge on said leading axial end and comprising a trough-shaped upwardly open sheet steel element having transversely spaced upper ends, a sheet steel cover portion extending upwardly form said upper ends and rearwardly towards said trailing axial end and formed with lateral soil displacing faces, and a transverse sheet steel wall connected said soil displacing faces and extending upwardly from said cutting edge and rearwardly toward said trailing axial end across said hollow interior of said annular body, said cover portion and wall forming a rigid unit with said sheet steel element; a reinforcing ring at said axial trailing end; a plurality of circumferentially spaced recesses in said body at said trailing axial end; and a plurality of pressure exerting means respectively engaged in said recesses for pressing said body into the soil and for controlling its direction of penetration into the same.

6. Apparatus as defined in claim 5, wherein said wall is uniformly inclined upwardly and rearwardly from said upper ends and over the entire height of said annular body.

7. Apparatus as defined in claim 6, wherein said soil-displacing faces include sections on said upper cylindrical portion of said annular body adjacent an upper end of said wall, said sections being at least in part flattened and slightly inclined towards the longitudinal symmetry axis of said body from opposite sides of said axis.

8. Apparatus as defined in claim 7, wherein said cover portion is provided at opposite sides of the longitudinal symmetry axis of said annular body with upwardly directed elongaged cutting edges which extend substantially symmetrically relative to said axis, said means including an upwardly open part-cylindrical sheet-steel member embracing said cover portion of said body on said leading axial end and being connected with said cover portion in the region of said elongated cutting edges.

9. Apparatus as defined in claim 8, wherein said elongated cutting edges extend upwardly of and rearwardly from said upper ends to said flattened parts of said sections and forming at said sections respective delimitations between said sections and said wall.

10. Apparatus as defined in claim 9, wherein said wall is curved transversely of the elongation of said body.

* * * * *